US009440459B1

(12) United States Patent
Fromm et al.

(10) Patent No.: US 9,440,459 B1
(45) Date of Patent: Sep. 13, 2016

(54) SYSTEM AND METHOD FOR TREATING SURFACE OF MEDIA WITH A DIGITALLY ADDRESSABLE DRYER ARRAY TO REDUCE MOISTURE GRADIENT AND MEDIA COCKLE

(71) Applicant: Xerox Corporation, Norwalk, CT (US)

(72) Inventors: Paul M. Fromm, Rochester, NY (US); Steven M. Russel, Bloomfield, NY (US); Brian C. Cyr, Penfield, NY (US); Jorge M. Rodriguez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/836,466

(22) Filed: Aug. 26, 2015

(51) Int. Cl.

| | |
|---|---|
| ***B41J 11/00*** | (2006.01) |
| ***B41J 2/01*** | (2006.01) |
| ***B41J 2/475*** | (2006.01) |
| ***B41J 2/447*** | (2006.01) |

(52) U.S. Cl.
CPC ..... *B41J 11/002* (2013.01); *B41J 2/01* (2013.01); *B41J 2/447* (2013.01); *B41J 2/475* (2013.01)

(58) Field of Classification Search
CPC ..... B41J 2/44; B41J 2/475; B41J 2/447; B41J 11/002
USPC ..... 347/5, 101, 102, 16
See application file for complete search history.

(56) References Cited

U.S. PATENT DOCUMENTS

| | | | | |
|---|---|---|---|---|
| 6,336,722 | B1 * | 1/2002 | Wotton | B41J 11/002 347/102 |
| 6,511,147 | B2 * | 1/2003 | Kubota | B41J 11/002 347/102 |
| 8,596,777 | B2 * | 12/2013 | Okamoto | B41J 11/002 347/102 |
| 2001/0000020 | A1 | 3/2001 | Roy et al. | |
| 2003/0020795 | A1 * | 1/2003 | Br | B41J 11/002 347/102 |
| 2009/0147039 | A1 | 6/2009 | Koase | |
| 2013/0300797 | A1 | 11/2013 | Azami et al. | |
| 2014/0204158 | A1 * | 7/2014 | Emamjomeh | B41J 11/0015 347/102 |

FOREIGN PATENT DOCUMENTS

JP 2012201044 A * 10/2012

* cited by examiner

*Primary Examiner* — Julian Huffman
*Assistant Examiner* — Sharon A Polk
(74) *Attorney, Agent, or Firm* — Maginot Moore & Beck LLP

(57) ABSTRACT

A printer comprises at least one printhead having a plurality of inkjets, a dryer having an array of radiators including a plurality of rows of radiators and a plurality of columns of radiators, a media transport configured to move media past the at least one printhead and the dryer, and a controller operatively connected to the at least one printhead, the dryer, and the media transport. The controller is configured to activate selectively the radiators in the array of radiators to heat the portions of the surface of the media on which ink has been ejected. A method for operating the printer is also disclosed.

17 Claims, 4 Drawing Sheets

SYSTEM AND METHOD FOR TREATING SURFACE OF MEDIA WITH A DIGITALLY ADDRESSABLE DRYER ARRAY TO REDUCE MOISTURE GRADIENT AND MEDIA COCKLE

TECHNICAL FIELD

This disclosure relates generally to inkjet printers, and, in particular, to media treatment in inkjet printers.

BACKGROUND

In general, inkjet printing machines or printers include at least one printhead that ejects drops or jets of liquid ink onto the surface of media. An inkjet printer employs inks in which pigments or other colorants are suspended in a carrier or are in solution with a solvent. Once the ink is ejected onto media by a printhead, the carrier is solidified or the solvent is evaporated to stabilize the ink image on the media surface. The ejection of liquid ink directly onto media tends to soak into porous media, such as paper, and change the physical properties of the media. Particularly with aqueous inkjet printing systems, water from the aqueous ink swells the cellulose fibers of the media and elongates the media in areas where an image is formed, but not in non-imaged areas. A moisture gradient is developed in the media due to these localized differences in moisture content and this gradient may problematically lead to localized lack of sheet flatness, which is commonly called media cockle. Media cockle adversely affects image quality.

Attempts have been made to reduce media cockle in previous printing systems. For example, printing systems utilizing web-fed media often apply a tension to the media to help elongate the dry areas to match the elongation of the wet areas. However, such media tension methods cannot be implemented in printing systems that utilize cut-sheet media due to the relatively short length of cut-sheet media compared to webs of media. Cut-sheet media printing systems often rely on a drying system that directs electromagnetic radiation or convection air to the surface of the media. These drying systems may lower the moisture content of the entire sheet of media, but they fail to address moisture gradients effectively since the gradients are caused by localized variations in moisture content attributable to varying amounts of aqueous ink ejected on the media at various locations. Printer configurations that reduce such media cockle are desirable.

SUMMARY

A printer, in one embodiment, comprises at least one printhead having a plurality of inkjets configured to eject ink, a dryer having an array of radiators, the array of radiators having a plurality of rows of radiators extending in a direction parallel to a process direction and a plurality of columns of radiators extending in a cross-process direction perpendicular to the process direction, each radiator configured to heat an area opposite the radiator at a predetermined distance, a media transport configured to move media past the at least one printhead to enable a surface of the media to receive ink ejected by the plurality of inkjets in the at least one printhead and to move the media in the process direction past the dryer to enable portions of the surface of the media to be heated by the radiators in the array of radiators, and a controller operatively connected to the at least one printhead, the dryer, and the media transport. The controller is configured to operate the plurality of inkjets in the at least one printhead to eject ink onto the surface of the media to form an image on the surface of the media, to operate the media transport to move the media past the at least one printhead and the dryer, and to activate selectively the radiators in the array of radiators to heat the portions of the surface of the media on which ink has been ejected.

A method of operating a printer is also disclosed. In one embodiment, the method comprises the steps of operating with a controller at least one printhead having a plurality of inkjets to eject ink to media, operating with the controller a media transport to move the media in a process direction past a dryer including an array of radiators to receive heat from the array of radiators, the array of radiators having a plurality of rows of radiators extending in a direction parallel to a process direction and a plurality of columns of radiators extending in a cross-process direction perpendicular to the process direction, and operating with the controller the dryer to selectively activate at least one of the radiators to direct heat to the media with respect to image data of the image formed on the media.

BRIEF DESCRIPTION OF THE DRAWINGS

The foregoing aspects and other features of a printing system with a digitally addressable dryer that reduces moisture gradients and media cockle are explained in the following description, taken in connection with the accompanying drawings.

DETAILED DESCRIPTION

Figure 1:
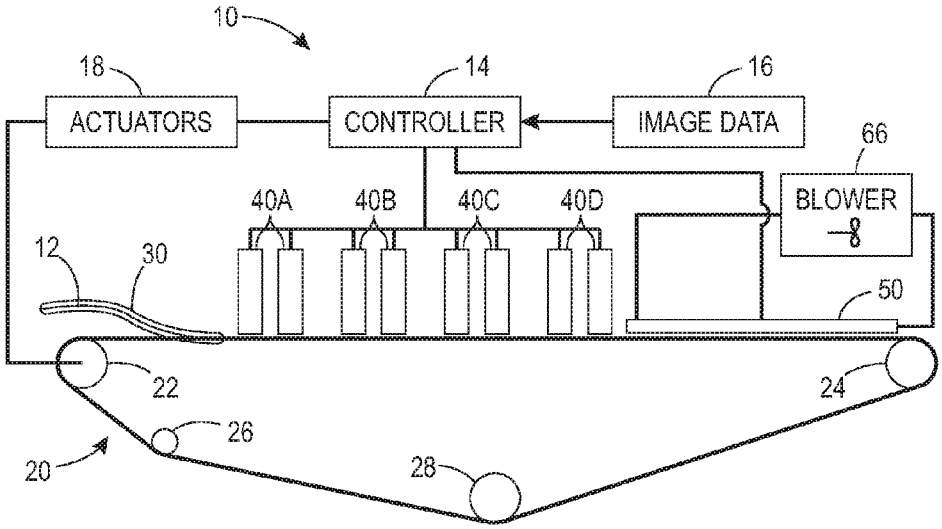
FIG. 1 is a schematic drawing of an inkjet printer that prints cut-sheet media.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. "Image data" refers to information in electronic form that are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant and solvent in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are staggered in diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction in the plane of the media. "Process direction" refers to the direction in which the image receiving surface is moving. As used in this document, the term "aqueous ink" includes liquid inks in which colorant is in a solution, suspension or dispersion with a liquid solvent that includes water and one or more liquid solvents. The terms "liquid solvent" or more simply "solvent" are used broadly to include compounds that may dissolve colorants into a solution, or that may be a liquid that holds particles of colorant in a suspension or dispersion without dissolving the colorant.

As used herein, the term "hydrophilic" refers to any composition or compound that attracts water molecules or other solvents used in aqueous ink. As used herein, a reference to a hydrophilic composition refers to a liquid carrier that carries a hydrophilic absorption agent. Examples of liquid carriers include, but are not limited to, a liquid, such as water or alcohol, that carries a dispersion, suspension, or solution of an absorption agent. A dryer then removes at least a portion of the liquid carrier and the remaining solid or gelatinous phase absorption agent has a high surface energy to absorb a portion of the water in aqueous ink drops while enabling the colorants in the aqueous ink drops to spread over the surface of the absorption agent. As used herein, a reference to a dried layer of the absorption agent refers to an arrangement of a hydrophilic compound after all or a substantial portion of the liquid carrier has been removed from the composition through a drying process. As described in more detail below, an indirect inkjet printer forms a layer of a hydrophilic composition on a surface of an image receiving member using a liquid carrier, such as water, to apply a layer of the hydrophilic composition. The liquid carrier is used as a mechanism to convey an absorption agent in the liquid carrier to an image receiving surface to form a uniform layer of the hydrophilic composition on the image receiving surface.

FIG. 1 illustrates a high-speed aqueous ink image producing machine or printer 10 with features that reduce or eliminate moisture gradient and media cockle induced by localized depositions of ink on media. As illustrated, the printer 10 is a printer that ejects ink drops directly on a surface of a sheet of media 12, and includes an electronic subsystem (ESS) or controller 14, an endless belt 20 with rollers 22, 24, 26, 28, a mechanical de-curler 30, a plurality of printhead modules 40A-40D, a digitally addressable dryer array 50, and actuators 18.

Controller 14 is operatively connected to actuators 18, printhead modules 40A-40D, and dryer array 50. Controller 14 is, for example, a self-contained, dedicated computer having a central processor unit (CPU) with electronic storage, and a display or user interface (UI). Controller 14 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

Controller 14 receives image data from an image data source 16, such as a scanner or application program. The controller 14 renders the image data and generates firing signals that are used to operate inkjet ejectors in the printheads of the modules 40A-40D to eject ink. The controller 14 also generates electrical signals to operate the actuators 18 to drive one or more rollers about which the endless belt 20 is entrained to move the endless belt about the rollers. The controller 14 further generates electrical signals corresponding to the image data from image source 16 to operate the dryer array 50 in a manner described more fully below.

Prior to an image being printed to media sheet 12, media sheet 12 is retrieved from media storage (not shown) and fed through mechanical de-curler 30 by belt 20. Mechanical de-curler 30 is configured with an S-shaped bend path, as shown in FIG. 1. The S-shaped bend path of mechanical de-curler 30 helps attenuate any irregularities the media may have from its loading into the printer or its storage in the printer. The configuration of the de-curler 30 is particularly effective to reduce irregularities of the media in the cross process direction of media 12. Sheet irregularities include folds, creases, wrinkles, or any other curl present in the media caused by media mishandling and other environmental factors, such as humidity. Preexisting sheet input curl is especially prevalent when cut-sheet media is used and the sheets are coated on one side only. In one embodiment, the curves in the S-shaped bend are symmetrical and have radii of between 5 to 20 mm (depending on the stiffness of substrate), which are useful to address sheet input curl in the first 3 to 5 inches of the media. The radii are at the lower end of this range for lower weights of media and at the higher end of the range for heavier weights of media.

After passing through mechanical de-curler 30, media sheet 12 travels on endless belt 20 beneath printhead modules 40A-40D so the printheads in the modules can eject ink onto one surface of the media with reference to image data from image data source 16. Although the printer 10 includes four printhead modules 40A-40D, each of which has two arrays of printheads, alternative configurations can include a different number of printhead modules or arrays within a module.

Figure 2:
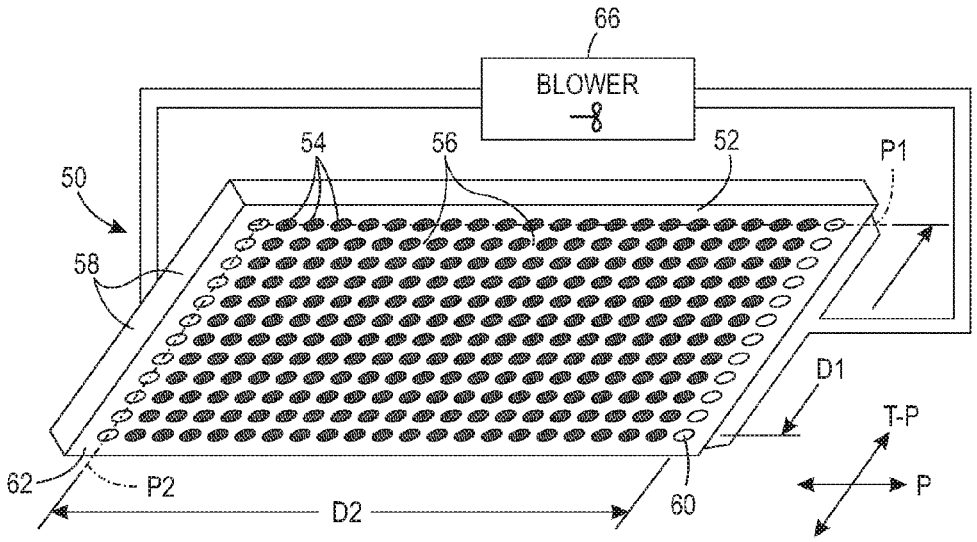
FIG. 2 is a schematic drawing of a dryer array used in the inkjet printer of FIG. 1.

After media sheet 12 passes by printhead modules 40A-40D, media sheet 12 passes under dryer array 50. As shown in FIG. 2, dryer array 50 includes a base 52 supporting a plurality of radiators 54 arranged in rows 56 extending in a process direction P1 and columns 58 extending in a cross-process direction P2. The radiators 54 are configured to be selectively actuated by controller 14 with respect to image data from image data source 16 to emit electromagnetic radiation towards portions of the media sheet 12 containing an image formed with ink ejected by the printhead modules 40A-40D. In one embodiment, the radiators 54 are infrared (IR) light emitting diodes (LEDs), each of which is configured to emit energy within the infrared (IR) spectrum, such as between 2-3 microns, although the radiators may be any other desired electromagnetic radiation emitter having any desired spectrum. Each radiator may be square-shaped, rectangular-shaped, circular-shaped, oval-shaped, diamond-shaped, or any other desired shape or combination of desired shapes.

In the embodiment shown, the outermost rows 56 of radiators 54 span a distance D1, and the outermost columns 58 span a distance D2. The distances D1, D2 are selected to span the entire printable area of media sheet 12 that passes under the dryer 50. In one embodiment, for example, the distance D1 is 8.5" and the distance D2 is 11" so that the dryer array 50 may cover media sheet 12 comprising standard-dimensioned 8.5" by 11" paper. However, the distances D1 and D2 in other embodiments may be any desired lengths corresponding to any desired printable area for the largest size of sheet passing through the printer. In one particular embodiment, the dryer array instead comprises a linear array of radiators with a single, or several, columns 58 that span a distance D1 corresponding to the width of media sheet 12, or the printable area within media sheet 12.

As media sheet 12 travels past dryer array 50, controller 14 controls dryer array 50 to direct electromagnetic radiation towards portions of media sheet 12 containing the ink image by selectively actuating only the radiators 54 located above a portion of the media sheet containing the ink image. In this manner, based on the timing and speed of the media sheet, the controller 14 dynamically actuates radiators 54 to minor the image passing under the dryer array 50 so that electromagnetic radiation is directed only to those portions of media sheet 12 containing the ink image as media sheet 12 passes under the radiators 54. Applying heat with radiators 54 in such a manner helps minimize media cockle induced by the deposition of ink on a media sheet by locally drying the media sheet only at portions of the media sheet where the ink image is formed. Targeting only portions of the media sheet containing the image further reduces moisture gradients compared with printing systems that dry the entire surface of the media sheet, or large areas or portions of the media sheet, including portions of the media sheet without the image, which provides for improved media cockle reduction.

The dryer array 50 defines a resolution depending on the type, size and number of radiators 54 in the dryer array 50, the spacing between each radiator 54, and the distance between the radiators 54 and media sheet 12. Generally, a dryer array having a relatively higher resolution can be controlled more precisely to direct electromagnetic radiation to preselected areas of the media sheet 12 corresponding to portions of a printed image than a dryer array with lower resolution. This precision is possible because the electromagnetic radiation emitted from any single radiator 54 directed towards media sheet 12 spreads outwardly depending on the type of lens of the radiator and the distance between the radiator and media sheet. As a result, the effective area dried by the electromagnetic radiation emitted from any single radiator 54 depends on the type and size of the radiator 54, and the distance between the radiator 54 and media sheet 12. As used herein, the term "effective drying area" refers to the area on media sheet 12 that a single radiator emits electromagnetic radiation to dry ink on the media, which depends on the type and size of the radiator, and the distance between the radiator and media. An array of radiators 54 that covers a relatively larger effective drying area with a relatively lower number of radiators 54 has a lower resolution in which electromagnetic radiation may overlap into areas of media sheet 12 without any portion of the image to ensure that all imaged areas of media sheet 12 are radiated. In contrast, an array of radiators 54 that covers a relatively lower effective drying area with a relatively higher number of radiators 54 has a higher resolution in which the effective drying area radiated by each radiator 54 is small enough to enable imaged portions of media sheet 12 to be dried with relatively little, or no, overlap with the non-imaged areas of the media sheet 12. Higher resolutions may provide for more refined drying to further reduce moisture gradient and media cockle depending on the size and complexity of the image printed.

In a particular embodiment, radiators comprise IR LEDs having a square-shape with each of the four sides being 2 mm in length. The dryer array is positioned with the radiators approximately 3 to 6 mm from the media sheet 12. At this distance, space is provided between the radiators and media to allow movement of media 12 beneath the radiators, and to further allow circulation of cooling air. Moreover, at this distance the radiators 54 are close enough to media sheet 12 to minimize spreading of the electromagnetic radiation outwards to yield an array having a sufficient resolution. Moreover, in such an embodiment, the pitch, or distance between the centerline of each radiator is approximately 2 mm, the distance D1 is approximately 365 mm, and the distance D2 is approximately 520 mm. This high resolution array has approximately 47,450 pixels or radiators 54, and is capable of directing electromagnetic radiation to intricate images jetted to media sheet 12 with low or little overlap into areas of media without the image.

With continued reference to FIG. 2 and FIG. 1, dryer array 50 further includes a plurality of vent perforations 60 and 62 operably coupled to a blower 66. In the embodiment shown, the vent perforations 60, 62 are arranged in columns in the cross-process direction P2. The blower 66 is configured to blow a cooling fluid, such as air, through the plurality of perforations 60, and suck the cooling fluid through the perforations 62. In this manner, heat produced by radiators 54 during operation may be removed by the cooling fluid to keep the radiators 54 cool. Furthermore, the air between media sheet 12 and radiators 54 may be moist due to water from the aqueous ink jetted to media sheet 12 being evaporated by the electromagnetic radiation emitted by radiators 54. Fluid flow from the perforations 60 past media sheet 12 and the radiators 54 and out through the perforations 62 removes moist air developed between media sheet 12 and radiators 54 and aids in increasing efficiency.

While the perforations 60 and 62 are shown positioned on either side of the array of radiators 56, perforations may be located at other advantageous positions. For example, a column of radiators 56 may be replaced with a column of vent holes 60, and another column of radiators 56 may be replaced with a column of vent holes 62. As another example, some of the radiators 56 in a column are replaced with vent holes 60 while some of the radiators 56 in another column are replaced with vent holes 62. In some particular embodiments, the vent holes do not replace the radiators 56 but are staggered between radiators 56. In one such particular embodiment, the vent holes 60 are staggered in "even" number columns, and vent holes 62 are staggered in "odd" number columns. In another particular embodiment in which square radiators 56 having side lengths of 2 mm are utilized in the dryer array 50, the vent holes 60, 62 have a pitch in both the process direction and the cross process direction of about 20 mm.

Figure 3:
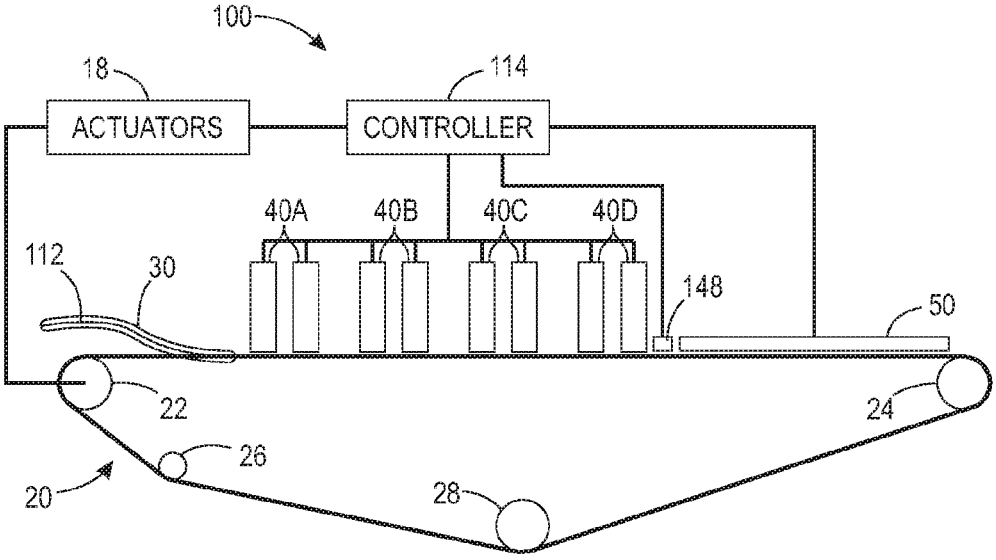
FIG. 3 is a schematic drawing of another inkjet printer that prints cut-sheet media

FIG. 3 illustrates a high-speed aqueous ink image producing machine or printer 100 with features that reduce or eliminate moisture gradient and paper cockling induced by the deposition of ink on a media. As illustrated, the printer 100 is substantially similar to the printer 10 of FIG. 1, where like numbers correspond to like parts, including an endless belt 20 with rollers 22, 24, 26, 28, a mechanical de-curler 30, a plurality of printhead modules 40A-40D, a digitally addressable dryer array 50, and actuators 18. Printer 100 further includes an image detector 148, and an electronic subsystem (ESS) or controller 114 operatively connected to actuators 18, printhead modules 40A-40D, image detector 148, and dryer array 50.

A media sheet 112 is retrieved from media storage (not shown) and fed by belt 20 through mechanical de-curler 30 and past printhead modules 40A-40D so the printheads in the modules can eject ink onto one surface of the media sheet with reference to image data from image data source 16 as explained above. After media sheet 112 passes by printhead modules 40A-40D, media sheet 112 passes under image detector 148 and dryer array 50. Image detector 148 in one embodiment includes a linear array of photo detectors configured to generate signals that are proportional to the amount of light reflected from an area of the media sheet 112 opposite each detector. Controller 114 is configured to process these signals received from image detector 148 and identify the areas onto which ink has been ejected and the areas not containing any ink. Radiators (not shown) of the dryer array 50 are selectively actuated by controller 114 with reference to identification of the inked areas obtained from the signals received from the image detector 148 to emit electromagnetic radiation towards the inked areas on the media sheet 112. Compared to printer 10 which requires controller 14 to process very high resolution video data 16 used to print the image in order to control the dryer array 50, data from image detector 148 does not require video processing in order to control the dryer array 50 with respect to printed image data since the image data is obtained from signals produced by image detector 148. Therefore, compared to dryer 50 of printer 10 (FIG. 1), dryer 50 of printer 100 (FIG. 3) can be controlled autonomously and free from video processing.

In one specific embodiment, the number of photo detectors and the pitch, or distance between, each photo detector in the detector 148, is selected to correspond to the number of rows of radiators and the pitch between the rows of radiators of the dryer. In this manner, one of the photo detectors of image detector 148 is aligned in the process direction P1 with a corresponding row of radiators of the dryer 50. Said another way, each row of radiators of the dryer 50 has a corresponding photo detector in detector 148. Controller 114 actuates the radiators 54 based on detection signals from image detector 148 and times their activation to mirror the image passing under the dryer array 50 so the electromagnetic radiation is directed only to portions of media sheet 112 onto which ink has been ejected.

Figure 4:
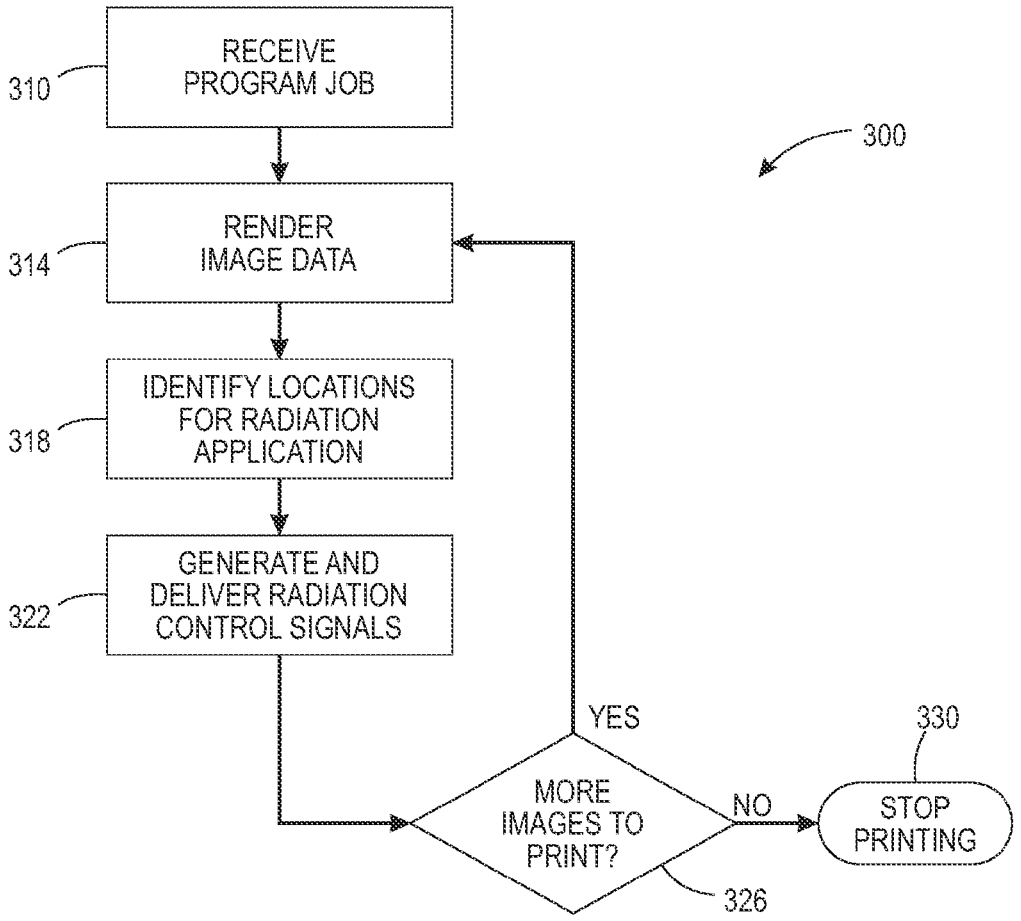
FIG. 4 is a flow diagram of a process for operating the inkjet printer of FIG. 1.
Figure 5:
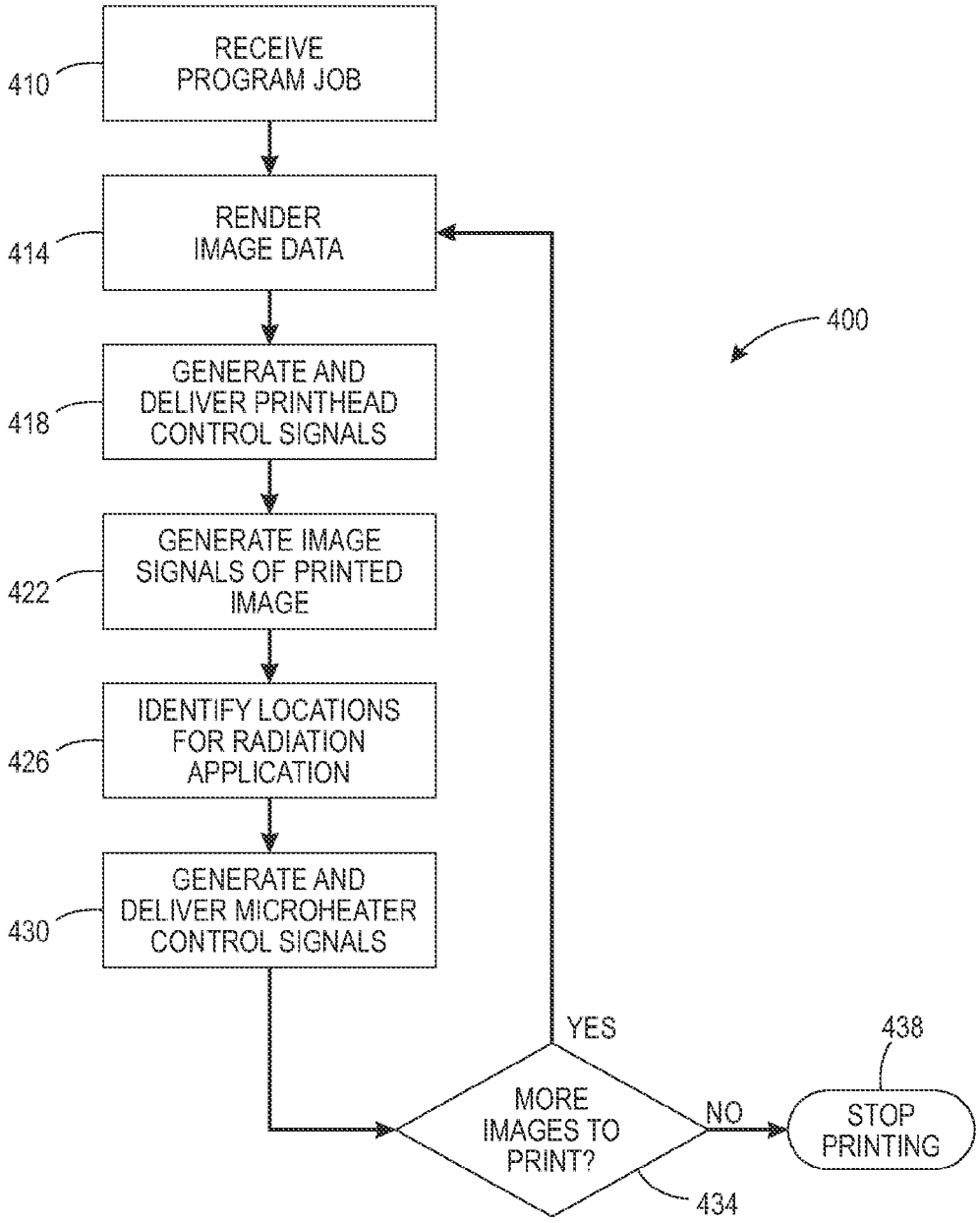
FIG. 5 is a flow diagram of a process for operating the inkjet printer of FIG. 3.

A process for operating a printer, such as printer 10 of FIG. 1, having a dryer array to reduce media cockle is shown in FIG. 4. A process for operating a printer, such as printer 100 of FIG. 3, having a dryer array to reduce media cockle is shown in FIG. 5. In the following description of these processes, statements that a process is performing some task or function refers to a controller or general purpose processor executing programmed instructions stored in a memory operatively connected to the controller or processor to manipulate data or to operate one or more components in the printer to perform the task or function. The controllers 14, 114 noted above can be such a controller or processor. Alternatively, controllers 14, 114 can be implemented with more than one processor and associated circuitry and components, each of which is configured to form one or more tasks or functions described herein.

According to process 300 of FIG. 4, upon receipt of a printing job (block 310), process 300 receives data of image content to be printed. These data are rendered to enable the process to generate the firing signals for the printheads (block 314). With reference to these data, the process maps the ink pixels to be printed to identify the areas on the sheet where an ink coverage or ink mass threshold is exceeded and curl is possible. The process then identifies the radiators in the dryer array above the media that correspond to these areas and where heat is to be applied by one of the radiators 54 (block 318). The signals for operating the radiators in the dryer array are generated and delivered to electrical current control devices, such as FETs, to enable current to flow to the radiators 54 corresponding to the areas where the ink coverage or mass could cause curl after the inkjet ejectors in the printheads are operated to print those areas and form an ink image on a media sheet (block 322). After printing the image and drying the image with the dryer array, the process determines whether more image data are to be printed (block 326). If more image data are to be printed, the process continues with the processing of block 314. Otherwise, the printing operation ends (block 330).

According to process 400 of FIG. 5, upon receipt of a printing job (block 410), process 400 receives data of image content to be printed. These data are rendered to enable the process to generate the firing signals for the printheads (block 414). With reference to these data, the signals for operating the printheads are generated and delivered to printheads to print those areas and form an ink image on the media (block 418). After printing the image, the image detector generates signals indicative of areas of ink coverage formed on the surface of the media (block 422). The process then processes these signals to identify the radiators in the dryer array above the media that correspond to these areas and where radiation is to be applied by one of the radiators (block 426). The signals for operating the radiators in the dryer array are generated and delivered to electrical current control devices, such as FETs, to enable current to flow to the radiators corresponding to the areas where the ink coverage or mass could cause curl after the inkjet ejectors in the printheads are operated to print those areas and form an ink image on the media (block 430). After printing the image and drying the image with the dryer array, the process determines whether more image data is to be printed (block 434). If more image data are to be printed, the process continues with the processing of block 414. Otherwise, the printing operation ends (block 438).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

at least one printhead having a plurality of inkjets configured to eject ink;

a dryer having an array of radiators and at least two vent openings, the array of radiators having a plurality of rows of radiators extending in a direction parallel to a process direction and a plurality of columns of radiators extending in a cross-process direction perpendicular to the process direction, each radiator configured to heat an area opposite the radiator at a predetermined distance, and the at least two vent openings being separated from one another in the process direction by a predetermined distance, each vent opening being configured to enable a flow of fluid to cool the array of radiators;

a blower configured to send a flow of fluid to one of the at least two vent openings and to receive the flow of fluid from the other of the at least two vent openings;

a media transport configured to move media past the at least one printhead to enable a surface of the media to receive ink ejected by the plurality of inkjets in the at least one printhead and to move the media in the process direction past the dryer to enable portions of the surface of the media to be heated by the radiators in the array of radiators; and a controller operatively connected to the at least one printhead, the dryer, the blower, and the media transport, the controller being configured to operate the plurality of inkjets in the at least one printhead to eject ink onto the surface of the media to form an image on the surface of the media, to operate the media transport to move the media past the at least one printhead and the dryer, to activate selectively the radiators in the array of radiators to heat the portions of the surface of the media on which ink has been ejected, and to operate the blower to circulate the flow of fluid through the at least two vent openings to cool the array of radiators.

2. The printer of claim 1, the controller being further configured to:

activate each radiator in the array of radiators in response to any portion of the surface of the media onto which ink has been ejected being opposite the radiator.

3. The printer of claim 2, the controller being further configured to:

deactivate each radiator in the array of radiator in response to the portion of the surface of the media onto which ink has been ejected is no longer opposite the radiator.

4. The printer of claim 1, the at least two vent openings further comprising:

a first plurality of vent openings extending in a column in the cross-process direction; and a second plurality of vent openings extending in a row in the process direction.

5. The printer of claim 1 further comprising:

at least one image sensor configured to generate signals corresponding to the surface of the media; and the controller is operatively connected to the at least one image sensor to receive the signals generated by the at least one image sensor and the controller being further configured to activate and deactivate the radiators in the array of radiators with reference to the signals received from the at least one image sensor.

6. The printer of claim 5 wherein the at least one image sensor is at least one photo detector.

7. The printer of claim 1 wherein each radiator in the array of radiators is an infrared emitter.

8. The printer of claim 7 wherein each infrared emitter in the array of radiators is an LED infrared emitter configured to generate electromagnetic radiation having a wavelength in a range of about two to about three microns.

9. A method of operating a printer comprising:

operating with a controller at least one printhead having a plurality of inkjets to eject ink to media;

operating with the controller a media transport to move the media in a process direction past a dryer including an array of radiators to receive heat from the array of radiators, the array of radiators having a plurality of rows of radiators extending in a direction parallel to a process direction and a plurality of columns of radiators extending in a cross-process direction perpendicular to the process direction;

operating with the controller the dryer to selectively activate at least one of the radiators to direct heat to the media with respect to image data of the image formed on the media; and operating with the controller a fan to circulate fluid through at least two vent openings in the dryer to cool the array of radiators, the at least two vent holes being spaced with respect to the process direction.

10. The printer of claim 9 further comprising:

operating with the controller the dryer with respect to image data to direct heat to the portion of the media containing the image by operating the controller to activate each radiator having a corresponding heat zone containing a portion of the media with at least a portion of the formed image.

11. The printer of claim 10 further comprising:

operating with the controller the dryer to selectively activate each radiator when the portion of the media containing the portion of the formed image enters the corresponding heat zone.

12. The printer of claim 10 further comprising:

operating with the controller the dryer to selectively deactivate the radiators after the portion of the media containing the formed image passes through the respective heat zone.

13. The printer of claim 9, further comprising:

operating with the controller a fan to circulate fluid through a first plurality of vent openings extending in a column in the cross-process direction and a second plurality of vent openings spaced with respect to the process direction and extending in a column in the cross-process direction.

14. The printer of claim 9 further comprising:

operating with the controller at least one image sensor to generate signals corresponding to image data of the image formed on the media.

15. The printer of claim 9 wherein:

operating with the controller at least one photo detector to generate signals corresponding to image data of the image formed on the media.

16. The printer of claim 9 wherein operating the plurality of radiators comprises operating a plurality of infrared emitters.

17. The printer of claim 16 wherein operating the plurality of infrared emitters comprises operating a plurality of LED infrared emitters to generate electromagnetic radiation having a wavelength of 2-3 microns.

* * * * *